US005653936A

United States Patent [19]

Enkner et al.

[11] Patent Number: 5,653,936

[45] Date of Patent: Aug. 5, 1997

[54] METHOD OF COOLING A HOT SURFACE AND AN ARRANGEMENT FOR CARRYING OUT THE METHOD

[75] Inventors: Bernhard Enkner; Ernst Fritz, both of Linz; Manfred Eysn, Linz/Puchenau; Rudolf Gruber, Linz; Peter Kickinger, Altmünster, all of Austria

[73] Assignee: Voest-Alpine Industrieanlagenbau GmbH, Linz, Austria

[21] Appl. No.: 506,833

[22] Filed: Jul. 25, 1995

[30] Foreign Application Priority Data

Jul. 25, 1994 [AT] Austria ..... 1471/94

[51] Int. Cl.[6] ..... C21B 7/16

[52] U.S. Cl. ..... 266/47; 266/193; 266/241

[58] Field of Search ..... 266/47, 241, 193

[56] References Cited

U.S. PATENT DOCUMENTS

| | | | |
|---|---|---|---|
| 4,815,096 | 3/1989 | Burwell | 373/74 |
| 5,290,016 | 3/1994 | Elsner | 266/193 |
| 5,330,161 | 7/1994 | Lehr et al. | 266/158 |

FOREIGN PATENT DOCUMENTS

| | | | |
|---|---|---|---|
| 0 044 512 | 1/1982 | European Pat. Off. . | |
| 0 202 057 | 11/1986 | European Pat. Off. . | |
| 0 393 970 | 10/1990 | European Pat. Off. . | |
| 0 506 151 | 9/1992 | European Pat. Off. . | |
| 2030944 | 2/1971 | Germany | 266/241 |
| 28 01 698 | 10/1978 | Germany . | |
| 1217508 | 9/1986 | Japan | 266/46 |
| WO 89/03011 | 4/1989 | WIPO . | |

OTHER PUBLICATIONS

Abstract of Japanese Patent 60–13005 of Jun. 23, 1985, *Patent Abstracts of Japan*, vol. 9, No. 125 (C–283) [1848], May 30, 1985.

*Primary Examiner*—Scott Kastler

*Attorney, Agent, or Firm*—Hill, Steadman & Simpson

[57] ABSTRACT

In a method of cooling a hot surface, a liquid cooling medium is atomized by a plurality of nozzles in a hollow space surrounding the surface and open towards the atmosphere. In order to ensure uniform continuous, yet just sufficient, cooling of the hot surface, with the cooling effecting with a constant temperature as possible over an extended period of time while avoiding changing thermal expansions of the hot surface, the liquid cooling medium is continuously atomized by means of unary nozzles to a fine mist having a droplet size ranging between 4 and 60 μm. The mist leaves the unary nozzles at a low speed and is moved along the hot surface within the hollow space surrounding the hot surface under utilization of the natural thermal current in the hollow space.

25 Claims, 2 Drawing Sheets

METHOD OF COOLING A HOT SURFACE AND AN ARRANGEMENT FOR CARRYING OUT THE METHOD

BACKGROUND OF THE INVENTION

The invention relates to a method and arrangement for cooling a hot surface, in particular the jacket of a metallurgical vessel, wherein a liquid cooling medium is atomized by means of a plurality of nozzles in a hollow space, which surrounds the surface and is opened towards the atmosphere.

Pyrometallurgical processes, as a rule, take place in vessels comprising a jacket of steel plate which is lined with refractory material in order to put up with the high process temperatures prevailing in the interior of the vessel. However, this lining does not always offer the opportunity of providing the low temperatures required for the strength of the steel jacket. In order to avoid wall temperatures that are too high it is known to cool the vessel wall by forced cooling with the aid of gaseous and/or liquid coolants, for instance, by means of surface irrigation cooling.

According to U.S. Pat. No. 4,815,096, whose disclosure is incorporated by reference thereto, water is sprayed in large amounts on the hot surface of the jacket of a metallurgical vessel within a chamber which closedly surrounds the hot surface and is subjected to an overpressure. The cooling water collecting in the chamber, which has not evaporated or condensed, is guided in circulation. However, difficulties have to be overcome, due to the collecting of the cooling water, when tilting the metallurgical vessel with the hot surface, primarily in order to avoid a loss of pressure within the chamber.

It is true that this cooling, and also surface irrigation cooling, offer advantages in terms of excellent heat transmission conditions; however, such cooling also involves the considerable disadvantage of the cooled vessels having to be as stationary as possible because of the required waste water collection means. The application of this type of cooling with tiltable converters or tiltable lids, etc., is feasible only to a limited extent. Besides, the good cooling obtained by a cooling of this type is not desired, anyway, since, as a result, quantities of heat that have to be produced in the process in a cumbersome and expensive way must be conveyed off.

Since no hot cooling medium would then have to be conveyed off any longer, it would be possible to eliminate these disadvantages by cooling by means of a gaseous medium. Yet, the main disadvantage involved therein is the very low heat capacity of the gaseous media, i.e., very large amounts of gas are required and, moreover, the heat transmission coefficients are low, thus requiring high flow speeds.

To avoid these disadvantages, it is known from EP-A-0 044 512 to spray water on the hot surface. The amount of water to be sprayed is a function of the water evaporated on the hot surface so that no backflowing cooling water need be collected. The coolant is sprayed in a closed chamber and the condensed water is collected and recycled.

In doing so, the cooling water must be supplied at a high speed and in large amounts in order to break the boundary layer on the hot surface. Although EP-A -0 044 512 already speaks of a droplet size of 100 μm at the most and of controlling the amount of sprayed-on water by means of a microprocessor on the basis of measured temperature values, too strong local and temporal cooling cannot be avoided. Consequently, it is necessary to provide means for turning on/turning off the spray which is controlled via thermocouples. However, the temperature changes occurring in the course of time, i.e., the high time-dependent temperature gradients, are dangerous with a view to excessive temperature stresses and symptoms of fatigue of the vessel jacket. Furthermore, cold spots are created within the spraying cone of the nozzles oriented directly towards the hot surface, and result in great temperature differences and hence high stresses.

EP-A 0 393 970, suggests a variant of the cooling method described above, wherein spraying is effected not directly on the surface to be cooled, but somewhat parallel to the same. According to that document, good uniform cooling effects are said to be obtained while avoiding a too abrupt cooling and by using only a slight or small number of nozzles.

However, there is a disadvantage to be seen in the mode of spraying of the cooling medium. According to EP-A -0 393 970, the coolant is sprayed by means of a binary nozzle, i.e., by aid of a gaseous medium. The following holds for the exit speeds of binary nozzles: The carrier gas emerges from the spraying nozzle, following the thermodynamic laws. Theoretically, a carrier gas reaches Laval speed, i.e., a speed near ultrasonic speed. With normal physical conditions prevailing, this means a speed of about 300 m/s. The water is injected into this stream under pressure and is entrained, hardly reducing the speed. As a result, such a nozzle has a very wide streaming range in which this speed is high and the streaming range itself extends up to 4 m. When impinging on a surface to be cooled which is approximately normal to the direction of the stream, a very good cooling effect is reached in a limited area. Since this results in cold spots, which must be avoided for reasons of strength as pointed out above, the nozzles according to EP-A -0 393 970 are arranged in a manner that the stream is ejected approximately parallel to the surface to be cooled. However, since the stream spreads conically and still has a very high speed at the point at which it impinges on the wall to be cooled, the risk of forming cold spots continues to exist.

Again, one is forced to provide turning on and off of the coolant supply in response to signals from thermocouples. This results in a strong dependence of the temperature of the surface to be cooled on time, i.e., the temperature fluctuations, which occur, exhibit a very large gradient as a function of the time.

Concerning the efficiency of binary nozzles injecting parallel to the wall to be cooled, as described in the prior art, in respect of their heat transformation, it is to be noted that the major portion of the cooling effect of the cooling medium is lost. This is because, as already pointed out, an external boundary wall, which is relatively cold, gets strongly involved in the cooling process due to the conical spreading of the emerging stream, which cannot even be prevented by specially designed flat nozzles. A considerable quantity of the gas/water mixture precipitates on this cool external boundary wall. This water only slightly participates in the heat transformation and runs off along the external wall. This may also cause condensation of already formed vapor.

In case such cooling is applied to a steelworks converter, two conduits (coolant and gaseous medium) are to be provided through a rotary introduction that is provided on the carrying trunnion of a converter carrying device (carrying ring). This involves increased expenditures both in terms of construction and in terms of maintenance.

SUMMARY OF THE INVENTION

The invention aims at avoiding these disadvantages and difficulties and has as its object to provide a method, as well as an arrangement for carrying out the method, which ensure the uniform and continuous and slight yet still sufficient cooling of a hot surface without carrying off too much heat. In particular, cold spots are to be avoided and a constant temperature as possible over the time is to be observable on the hot surface so that changing thermal expansions and temporary turn-offs of the cooling are avoided.

In accordance with the invention, this object is achieved in that the liquid cooling medium is continuously atomized by means of unary nozzles to a fine mist having a droplet size ranging between 4 and 60 μm and that the mist leaves the unary nozzles at a low speed and is moved along the hot surface within the hollow space surrounding the hot surface under utilization of the natural thermal current in the hollow space.

It has been shown that, due to the natural ascending force caused by the natural thermal current, a speed of the gases, which are moving along the hot surface of a metallurgical vessel in operation, will adjust to about 1.5 and 2 m/s. This will provide a very efficient heat transfer merely on account of the ascending force even at a very low exit speed or very slight range of action of the coolant. With the combined use of unary nozzles, in which the ejection speed is already markedly lower after a substantially shorter distance upon emergence from the nozzle than with binary nozzled (a marked reduction of speed being recognizable already after a distance of 200 mm from the nozzle in case of unary nozzles and only after at least 1 m away from the nozzle in case of binary nozzles), an excellent spreading and thorough mingling with the surrounding atmosphere of the stream emerging from the unary nozzle is obtained. Due to the mist being formed by unary nozzle and comprising only very little droplets, this mist, in connection with thorough mingling, offers a very long life. Condensation of the mist on cool surfaces cannot be avoided even with the use of a unary nozzle, yet such condensation is to be expected to take place only at a substantially later point of time because of the long life of the mist. Since, in addition, a slight amount of coolant will do because of the strong ascending force, substantially less formation of condensate than in the prior art is created.

As opposed to the known binary nozzle, the unary nozzle employed in accordance with the invention offers a substantially better automatic controllability so that a time-constant cooling behavior, i.e., a temperature of the hot surface that is uniform over a long period of time, can be guaranteed in a substantially simpler way than with a binary nozzle. With a binary nozzle, the gaseous medium must reach the maximum exit speed attainable, i.e., Laval speed. This speed remains constant down to a critical pressure depending on the medium of the gas in terms of its physical conditions and cannot be automatically controlled. It is only below that pressure that the speed can be controlled automatically. Above the critical pressure, the gas amount follows a root law and, therefore, is dependent on a pressure change to only a slight extent.

The water supplied to the binary nozzle likewise is nozzled or injected into the gas stream at an overpressure. The amount of water is proportional to the exit speed and the exit speed likewise follows a root law of the pressure of the liquid over the entire pressure range.

For all of these reasons, automatic control in the coordination of the two media cannot be readily accomplished with binary nozzles. According to the prior art, this problem is circumvented by temporarily turning on and off the water and gas circulation, to which end thermocouples are attached to the hot surface. These thermocouples act on control valves located outside of the system and respond to a minimum value and a maximum value of the hot surface.

By contrast, according to the invention, periods in which cooling is too strong and periods in which cooling does not take place at all (in order to allow the hot surface to regain the desired temperature level) can be avoided. The automatic control of the amount of cooling medium is substantially simpler with a unary nozzle and to adjust the amount of cooling medium a simply triggered pressure reducing valve will do. This allows for a volume-controlled and/or volume-adjusted supply effective over the total period of time, i.e., without any interruption of the cooling effect, without requiring any additional control-engineering expenditures.

Thus, a particularly effective cooling despite reduced amounts of water due to the natural ascending force and the long life of the mist, yet a particularly gentle cooling on account of the fine droplets of the mist, is obtained according to the invention, which ensures a constant temperature on the hot surface even over very long periods of time without requiring periodic turning on and off of the cooling media.

Preferably, mist having a droplet size ranging between 4 and 10 μm is produced. This fine mist is particularly long-lasting.

According to the invention, the exit speed of the coolant from the unary nozzle is particularly low. Preferably, the range is between 10 and 30 m/s, which is lower than with a binary nozzle by approximately one power of ten.

Due to this speed, a slight coverage by the mist emerging from the unary nozzle is also ensured. It ranges between 100 and 400 mm, preferably between 200 and 300 mm. In other words, without considering the natural thermal current, the mist upon emergence from the unary nozzle will come to a standstill after travelling a maximum of 400 mm, preferably after a maximum of 300 mm, which is essential to providing a gentle uniform cooling.

According to a preferred embodiment, the mist upon emergence from the unary nozzles at first moves in a direction approximately perpendicular to the hot surface, and deflection of the movement of the mist into a direction approximately parallel to the hot surface is effected by the natural thermal current.

Preferably, a partial condensation of the mist emerging from the unary nozzles is induced in the immediate surroundings of the unary nozzles. Therefore, it is feasible to avoid condensation on undesired points.

According to a preferred embodiment, zones of different heat application are provided with groups of nozzles in which the amount of coolant is adapted to the respective heat application.

An arrangement for carrying out the method according to the invention comprises a body having a hot surface, in particular a metallurgical vessel having a hot jacket, wherein the hot surface is surrounded at a distance by a shielding forming a hollow space that is open toward the atmosphere, and comprising a plurality of nozzles injecting cooling medium into the hollow space, and has an improvement of the nozzles being unary nozzles.

Preferably, the outlet openings of the unary nozzles are oriented in a manner that a mist, which is produced, has a direction of movement at the outlet openings oriented approximately perpendicular to the hot surface. The unary nozzles advantageously are arranged at a distance from the hot surface of between 100 and 300 mm and, furthermore, each of the unary nozzles is preferably arranged within a protection tube which enters the hollow spaced formed by the shielding.

It is advantageous if a droplet barrier is arranged at the entry of the protection tube into the hollow space. This will deliberately induce a partial condensation at one point of emergence of the mist in order to avoid condensation at undesired points.

Suitably, the unary nozzles are arranged from the entry of the protection tube into the hollow space at a distance, which approximately corresponds to the diameter of the protection tube. The diameter of the protection tube advantageously corresponds to approximately half of the interspace between the shielding and the hot surface.

Preferably, at least one temperature measuring means is provided on the hot surface, which means is coupled with the control of a pressure adjustment device for at least one of the unary nozzles. According to a preferred embodiment, the temperature measuring means comprising a bimetal means and a lever system, which is engaged with the bimetal means and which effect the adjustment of the pressure for the unary nozzles.

Preferably, a length compensation element including a damping cylinder is provided for balancing out changes in the position of the hot surface relative to the lever system. The length compensation element offers two settings for a new calibration, namely one for a maximum and one for a minimum excursion of the damping cylinder.

Preferably, each of the unary nozzles is associated with a temperature measuring means and each of the unary nozzles is adjustable individually in respect of pressure and/or amount of cooling medium.

A preferred embodiment is characterized in that the hot surface is constituted by the jacket of an electric arc furnace, wherein the hollow space formed by the shielding extends as far as to the electrode or electrodes and there is connected to the atmosphere via an annular opening extending peripherally about the electrodes. Thereby, it is feasible to obtain a particularly effective cooling not only of the hot surface, but also of the electrodes passing through the hot surface.

Preferably, the unary nozzles can be either hydraulic unary nozzles or ultrasonic unary nozzles.

Other advantages and features of the invention will be readily apparent from the following description of the preferred embodiments, the drawings and claims.

DESCRIPTION OF THE PREFERRED EMBODIMENTS

Figure 1:
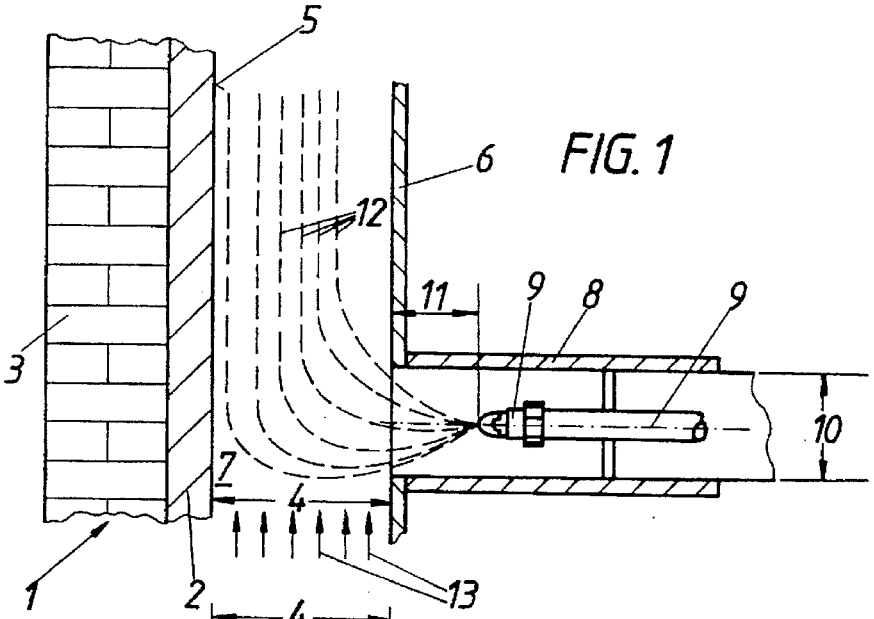
FIG. 1 is a schematic cross sectional view of a first embodiment of the present invention.

The principles of the present invention are particularly useful when incorporated in a cooling arrangement for a metallurgical vessel, generally indicated at 1 in FIG. 1. The vessel I has a jacket 2 of steel plate, which jacket is lined with a refractory lining 3. A shielding 6, for instance a slag protection means (or in the case of a converter a side wall of a carrying ring of the tiltable steelworks converter) is provided at an approximately equidistant distance 4 from an outer surface 5 of the jacket 2 of the metallurgical vessel 1, which shielding likewise is made of steel plate. By this shielding 6, a hollow space 7 is formed, which is upwardly and downwardly open toward the atmosphere and peripherally surrounds the jacket 2 of the metallurgical vessel 1.

This shielding 6, at predetermined intervals, is provided with tubes 8, which are oriented approximately perpendicular to the surface of the jacket and enter the hollow space 7 formed between the shielding 6 and the jacket 2. These tubes 8 serve as protection tubes for accommodating unary nozzles 9, such as, for instance, hydraulic unary nozzles or ultrasonic unary nozzles. The tubes 8 each have an internal diameter 10 corresponding to the distance 11 of the unary nozzles 9 from the entry or mouth of the tubes 8 into the hollow space 7 and to approximately half of the distance 4 between the shielding 6 and the surface 5 of the jacket 2.

A very fine mist 12 with a droplet size preferably between 4 and 10 μm is produced by means of the unary nozzles 9. The mist, although oriented or directed towards the surface 5 of the jacket 2 at an approximately right angle, is deflected upwards immediately upon entry in to the hollow space 7 formed between the shielding 6 and the jacket 2 of the metallurgical vessel I due to the enormous ascending force, which is up to 2 m/s and is indicated by arrows 13, and the relatively low exit speed of the droplets from the unary nozzles 9. The ascending force, thus, essentially contributes to the flow formation, and uniformly distributes the fine mist 12 within the hollow space 7. By the ascending force, which serves as a conveying means, the mist 12 is safely brought to the surfaces to be cooled, i.e., the hot surface 5 of the jacket 2 of the metallurgical vessel 1.

Figure 2:
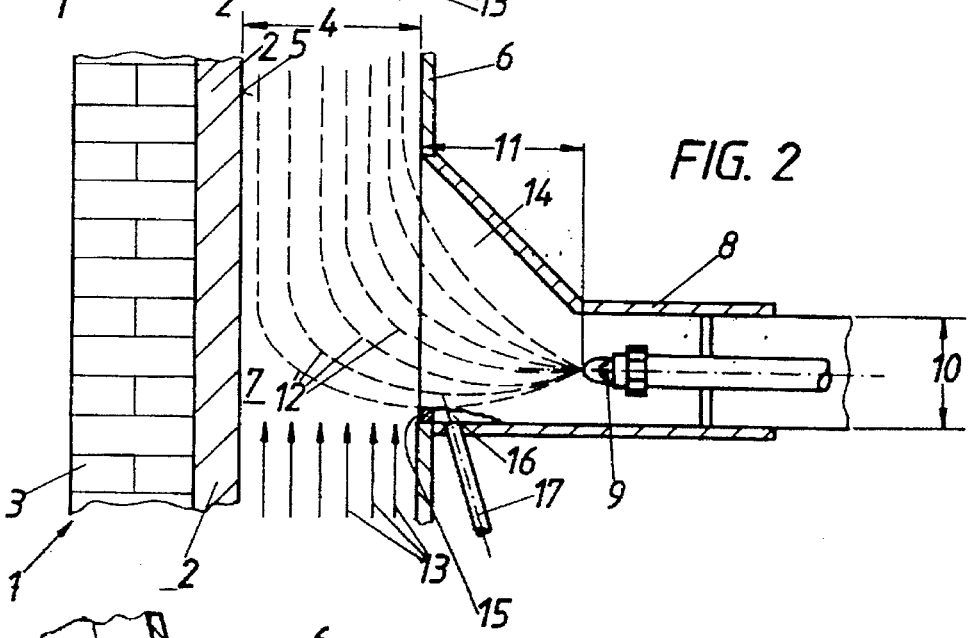
FIG. 2 is a schematic cross sectional view of a second embodiment of the present invention.

According to the embodiment illustrated in FIG. 2, an impact and retaining means 15 is provided for the mist 12 at the entry of the tube 8 into the hollow space 7—which entry is widened like a funnel by a mouth 14 in the direction toward the hot surface 5. The impact and retaining means 15 serves to avoid the formation of a condensate on the shielding 6 at extremely low temperatures of the shielding 6. Thus, the condensate 16 forms on the impact and retaining means 15 and not on undesired points within the hollow space 7. The condensate 16 is allowed to flow out of the protection tube 8 via a discharge duct 17.

Figure 3:
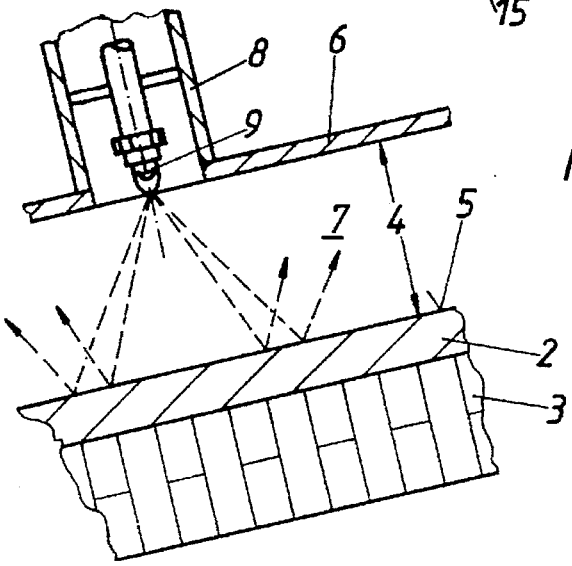
FIG. 3 is a schematic cross sectional view of a third embodiment of the present invention.

FIG. 3 shows an almost horizontally arranged hot surface 5 of a metallurgical vessel 1. The unary nozzle 9 is located nearly at the entry of the tube 8 into the hollow space 7. The hot surface 5 may be formed, for instance, by the lid of a metallurgical vessel 1. With an almost horizontally arranged hot surface, the increase in the ascending force by the forming vapor is of great importance.

Figure 4:
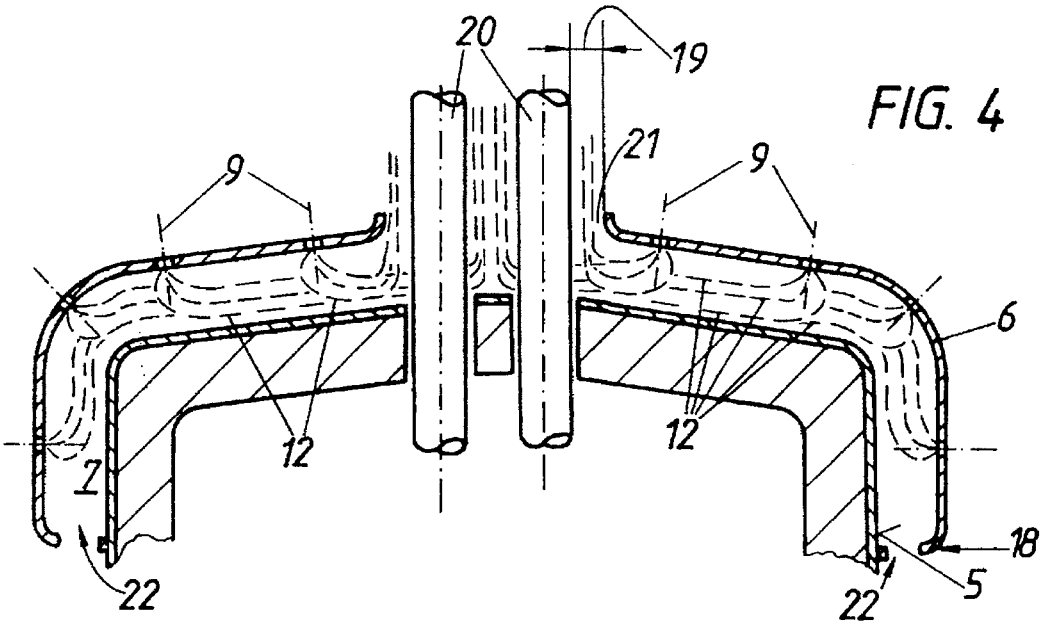
FIG. 4 is a schematic cross sectional view of the invention applied to an electric arc furnace.

FIG. 4 shows the arrangement of the unary nozzles 9 on a lid 18 of a metallurgical vessel 1, which is designed as an electric arc furnace. The shielding 6 surrounds the hot surface 5 of the jacket 2 of the metallurgical vessel 1, i.e., its lid 18, and terminates at a distance 19 relative to the electrodes 20 so that a free annular opening 21 is formed between the shielding 6 and the electrodes 20. Air flows into the border zone 22 of the lid 18, emerging at the center of the lid 18, i.e., in the annular space 21 formed between the shielding 6 and the electrodes 20. This results in a particularly good effect for heat transmission, since the flow speeds, which are directed radially towards the center, strongly increase in the direction towards the center. Since the electrodes 20, as a rule, are arranged centrically and are guided through the lid 18 of the electric arc furnace in a centrically arranged manner to, thus, project into the metallurgical vessel 1 at a point at which the cooling medium leaves the hollow space 7 between the shielding 6 and the hot surface 5 at the highest speeds, a particularly good cooling effect is obtained for the electrodes 20 despite the low ejection speed of the mist 12 from the unary nozzles 9.

Figure 5:
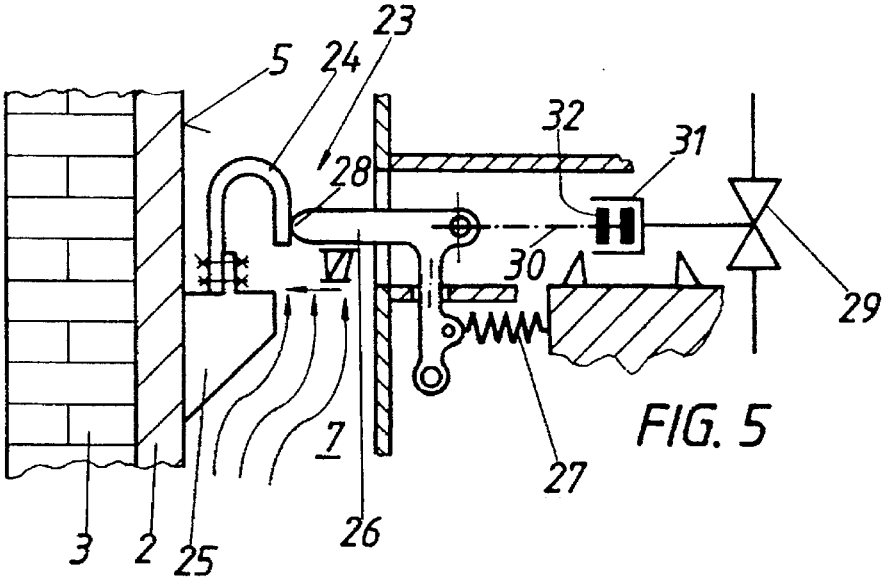
FIG. 5 is a cross sectional view with portions in elevation of an automatic control means for adjusting the amount of mist from a nozzle.
Figure 6:
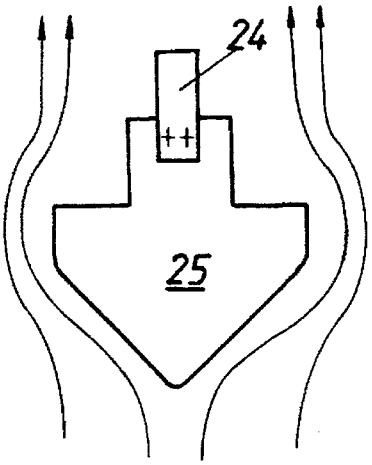
FIG. 6 is a view taken in the direction of arrow VI in FIG. 5.

Temperature measuring means 23, which require only little expenditures in terms of control-engineering and which enable the automatic control respectively adjustment of the pressure of the cooling medium at the unary nozzles 9, are illustrated in FIGS. 5 and 6. The temperature measuring means 23 represented in FIG. 5 comprises a bimetal element 24, which is fastened to a bimetal retaining means 25 arranged on the jacket 2 of the metallurgical vessel 1. The bimetal retaining means 25 is surrounded by protective plates to avoid the direct cooling effect of the cooling medium. The bimetal element 24 acts on a transmission unit 26, which is designed as a rotary lever which is mounted to rotate around an axle or point 50. A pressure spring 27 acting on this rotary lever 26 creates the necessary application pressure between the bimetal element 24 and the tip 28 of the rotary lever. Thus, the safe contact between these two elements is ensured.

In case of a change of temperature, a pressure reducing valve 29 controlled by the rotary lever 26 is actuated via the angular change of the bimetal element 24 and via the rotary lever 26, thus changing the amount of cooling medium emerging from the unary nozzle 9. In order to leave the function of the temperature measuring means 23 unaffected by any change in the position of the hot surface 5, for instance by the converter expanding at a temperature increase, a length compensation element 30 is arranged between the rotary lever 26 and the pressure reducing valve 29. The length compensation element 30 comprises two settings and forces a cylinder 31 into end positions. These end positions also correspond to the end positions of the pressure reducing valve 29. A damping piston 32 within this cylinder 31 allows for any mutual position of the parts concerned and is able to transmit adjustment forces, nevertheless.

The control system illustrated in FIGS. 5 and 6 operates instantaneously and directly.

In case of a locally limited high wear of the refractory lining, e.g., in case of an imminent breakthrough, local overheatings, called hot spots, of the surfaces to be cooled occur with metallurgical vessels. If a plurality of nozzles 9 are pooled in terms of control engineering, no adequate response to the required locally limited heat discharge is feasible in case of locally limited overheating. Either the cooling will not react, for instance, if the thermocouple is not arranged immediately at, or in the vicinity of, this hot surface to be cooled, or too large a surface will be too greatly cooled.

In order to avoid disadvantages of this kind, it is suitable to additionally arrange a defined number of unary nozzles 9 and equip the same with valves reacting only from a predetermined temperature level, which is a function of the type of metallurgical vessel used. Thus, each nozzle 9 has a separate control means.

The invention is not limited to the embodiments illustrated, but may be modified in various aspects. Thus, an ejection direction of the unary nozzles deviating from the direction perpendicular to the hot surface is feasible, if not suitable for certain purposes of use (e.g., positions of the hot surface).

We claim:

1. In a method of cooling a hot surface by aid of a liquid cooling medium, by providing a hollow space surrounding said hot surface and open towards the atmosphere and by atomizing said liquid cooling medium by providing a plurality of nozzle means for discharging into said hollow space, the improvements comprising:

said step of providing a plurality of nozzle means providing only unary nozzles;

continuously atomizing said liquid cooling medium by said unary nozzles so as to produce a fine mist having a droplet size ranging between 4 and 60 μm in a manner that said mist leaves said unary nozzles at a low speed; and moving said fine mist along said hot surface in said hollow space surrounding said hot surface by utilizing the natural thermal current in said hollow space.

2. In a method according to claim 1, wherein said step of providing a fine mist provides a mist with a droplet size ranging between 4 and 10 μm.

3. In a method according to claim 1, wherein the step of providing the fine mist has the mist leaving the unary nozzles at a speed ranging between 10 and 30 m/s.

4. In a method according to claim 1, wherein a unary nozzle is used, by which said fine mist—without considering the natural thermal current—is sprayed to a maximum distance in a range of between 100 and 400 mm.

5. In a method according to claim 4, wherein said fine mist is sprayed to a maximum distance in a range of between 200 and 300 mm.

6. In a method according to claim 1, wherein said fine mist, upon emergence from said unary nozzles, at first is moved in a direction approximately perpendicular to said hot surface and then is deflected by the natural thermal current into a direction approximately parallel to said hot surface.

7. In a method according to claim 1, further comprising inducing a partial condensation of said fine mist emerging from said unary nozzles to take place in the immediate surroundings of each unary nozzle.

8. In a method according to claim 1, further comprising adjusting the amount of cooling medium by adjusting the pressure of said cooling medium at said unary nozzles.

9. In a method according to claim 1, wherein said hot surface has zones of different heat application to be cooled, and said method includes providing said zones of different heat application with groups of unary nozzles and quantitatively adapting said cooling medium to the heat application of the respective one of said zones of different heat application.

10. An arrangement for cooling a body having a hot surface by atomization of a cooling medium, said arrangement including a shielding arranged at a distance from said hot surface so as to form a hollow space surrounding said hot surface and open towards the atmosphere and a plurality of nozzle means adapted to inject said liquid cooling medium into said hollow space, said nozzle means including only unary nozzles and producing a fine mist having a droplet size in a range between 4 and 60 μm in a manner that said fine mist leaves said unary nozzles at a low speed and is moved along said hot surface in said hollow space surrounding said hot surface under utilization of the natural thermal current in said hollow space.

11. An arrangement according to claim 10, wherein said unary nozzles have outlet openings oriented in a manner that a fine mist having a direction of movement at said outlet openings approximately perpendicular to said hot surface is produced.

12. An arrangement according to claim 10, wherein said unary nozzles are arranged at a distance from said hot surface in a range between 100 and 300 mm.

13. An arrangement according to claim 10, further comprising protection tube means arranged so as to enter said hollow space, each of said protection tube means accommodating a respective one of said unary nozzles.

14. An arrangement according to claim 13, further comprising a droplet barrier arranged at the entry of said protection tube means into said hollow space.

15. An arrangement according to claim 13, wherein said unary nozzles are arranged at a distance from the entry of said protection tube means into said hollow space, said distance approximately corresponding to a diameter of said protection tube means.

16. An arrangement according to claim 15, wherein the diameter of said protection tube means approximately corresponds to half of the distance between said shielding and said hot surface.

17. An arrangement according to claim 10, further comprising at least one temperature measuring means provided on said hot surface and a pressure adjustment means for at least one of said unary nozzles, said pressure adjustment means including a control means coupled with said temperature measuring means.

18. An arrangement according to claim 17, wherein said temperature measuring means comprises a bimetal means and a lever system for transferring movement from said bimetal means to the control means.

19. An arrangement according to claim 18, further comprising a length compensation means provided for balancing out changes in the position of said hot surface relative to said lever system, said length compensation means including a damping cylinder and offering a first setting for a maximum excursion of said damping cylinder and a second setting for a minimum excursion of said damping cylinder to be used for new calibration.

20. An arrangement according to claim 17, wherein a temperature measuring means is allocated to each of said unary nozzles and each of said unary nozzles is adjustable individually in respect of at least one of the pressure and the amount of cooling medium.

21. An arrangement according to claim 10, wherein said body having a hot surface to be cooled is a metallurgical vessel.

22. An arrangement according to claim 10, wherein said body having a hot surface to be cooled is an electric air furnace including at least one electrode and said hot surface is a jacket of said electric arc furnace, said hollow space formed by said shielding extending as far as said at least one electrode and having an annular opening peripherally extending about said at least one electrode so as to connect said hollow space to the atmosphere.

23. An arrangement according to claim 10, wherein said unary nozzles are comprised of hydraulic unary nozzles.

24. An arrangement according to claim 10, wherein said unary nozzles are comprised of ultrasonic unary nozzles.

25. In a method according to claim 1, wherein the hot surface is a jacket of a metallurgical vessel.

* * * * *